US010421007B2

(12) United States Patent
Riordan et al.

(10) Patent No.: US 10,421,007 B2
(45) Date of Patent: Sep. 24, 2019

(54) AUTOMATIC PLAYING CARD SHUFFLER AND OTHER CARD-HANDLING DEVICES CONFIGURED TO DETECT MARKED CARDS AND METHOD OF USING THE SAME

(71) Applicant: Shark Trap Gaming & Security Systems, LLC, Las Vegas, NV (US)

(72) Inventors: Michael Earnest Riordan, Las Vegas, NV (US); Louis Wilson DeGregorio, Las Vegas, NV (US); Keith Marty Taft, Santa Clara, CA (US)

( * ) Notice: Subject to any disclaimer, the term of this patent is extended or adjusted under 35 U.S.C. 154(b) by 0 days.

(21) Appl. No.: 15/362,567

(22) Filed: Nov. 28, 2016

(65) Prior Publication Data

US 2017/0072295 A1 Mar. 16, 2017

Related U.S. Application Data

(60) Division of application No. 15/001,039, filed on Jan. 19, 2016, now Pat. No. 9,776,072, which is a continuation of application No. PCT/US2014/047227, filed on Jul. 18, 2014.

(60) Provisional application No. 61/847,710, filed on Jul. 18, 2013.

(51) Int. Cl.

| | |
|---|---|
| ***A63F 1/12*** | (2006.01) |
| *A63F 9/06* | (2006.01) |
| *A63F 9/24* | (2006.01) |

(52) U.S. Cl.

CPC ..... *A63F 1/12* (2013.01); *A63F 2009/0609* (2013.01); *A63F 2009/2419* (2013.01); *A63F 2250/287* (2013.01); *A63F 2250/58* (2013.01)

(58) Field of Classification Search

None

See application file for complete search history.

(56) References Cited

U.S. PATENT DOCUMENTS

| | | | | |
|---|---|---|---|---|
| 6,010,131 | A * | 1/2000 | Myers | A63F 1/06 273/148 R |
| 6,886,829 | B2 | 5/2005 | Hessing et al. | |
| 7,735,657 | B2 | 6/2010 | Johnson | |
| 7,764,836 | B2 | 7/2010 | Downs, III et al. | |
| 7,933,448 | B2 | 4/2011 | Downs, III | |
| 7,976,023 | B1 | 7/2011 | Hessing et al. | |

(Continued)

*Primary Examiner* — Jay Liddle
*Assistant Examiner* — Alex F. R. P. Rada, II
(74) *Attorney, Agent, or Firm* — FisherBroyles, LLP; Rob L. Phillips

(57) ABSTRACT

An automatic playing card shuffler incorporating means for detecting marked cards. One or more light spectrum emitters or variable light spectrum illuminators transmit light at frequencies/wavelengths which is reflected off card backs through one or more spectrum filters causing invisible markings to become visible. A camera may capture images of the now visible markings. A camera and software collaborate to capture images and analyze the same for markings on the card backs such as smudges, nicks and scuffs and edge demarcations. The automatic playing card shufflers are configured to not only detect marked cards but to detect patterns relative to the card markings. The automatic card shufflers are communicatively linked with a casino management system and/or security system such that casino personnel may be alerted in real time to the discovery of marked cards.

16 Claims, 7 Drawing Sheets

(56) References Cited

U.S. PATENT DOCUMENTS

| | | | | |
|---|---|---|---|---|
| 8,012,029 | B2 | 9/2011 | Johnson | |
| 8,070,574 | B2 | 12/2011 | Grauzer et al. | |
| 8,150,157 | B2 | 4/2012 | Downs, III et al. | |
| 8,777,710 | B2 | 7/2014 | Grauzer et al. | |
| 8,986,091 | B2 | 3/2015 | Grauzer et al. | |
| 9,259,640 | B2 | 2/2016 | Grauzer et al. | |
| 9,339,723 | B2 | 5/2016 | Grauzer et al. | |
| 2007/0102879 | A1* | 5/2007 | Stasson | A63F 1/12 273/149 R |
| 2014/0347471 | A1* | 11/2014 | Blazevic | G01N 21/8806 348/128 |

* cited by examiner

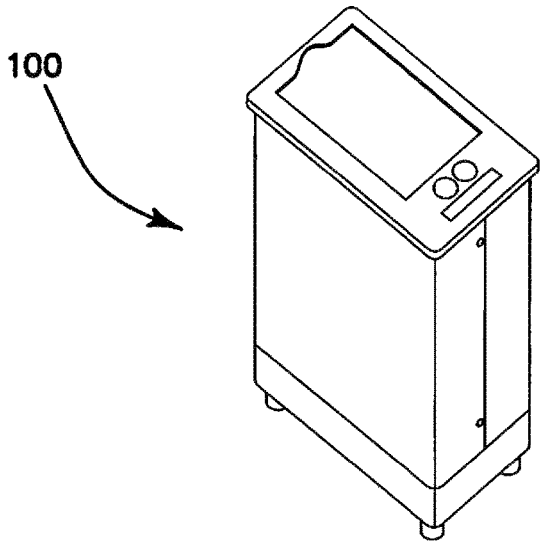
FIG. 1A
FIG. 1B
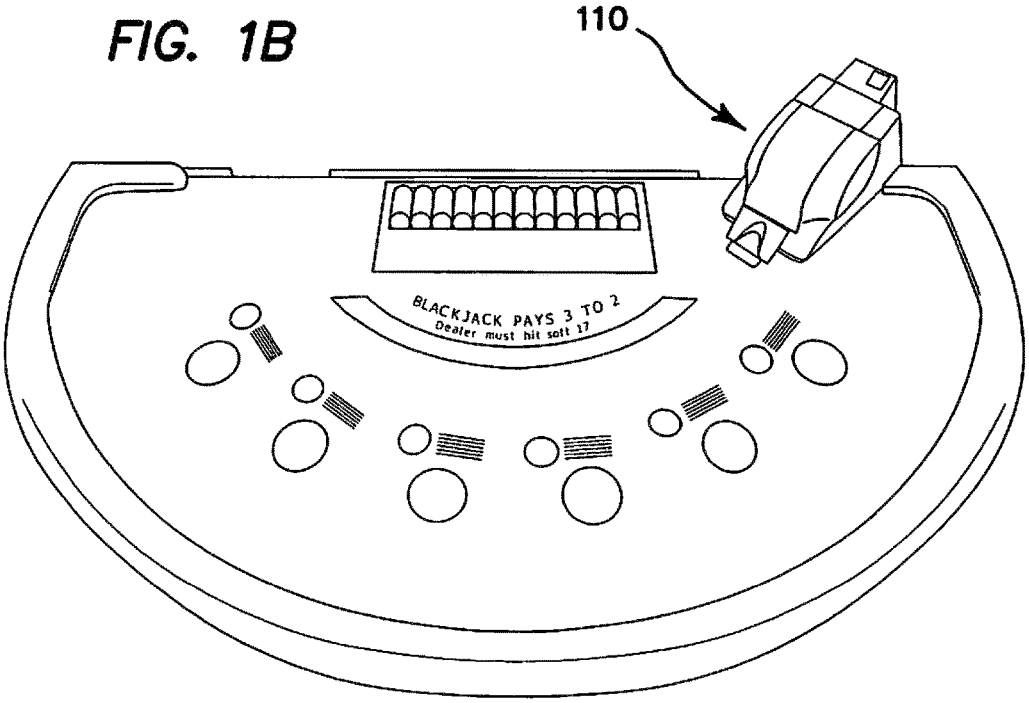

AUTOMATIC PLAYING CARD SHUFFLER AND OTHER CARD-HANDLING DEVICES CONFIGURED TO DETECT MARKED CARDS AND METHOD OF USING THE SAME

CROSS-REFERENCE

This application is a divisional application of U.S. patent application Ser. No. 15/001,039 filed Jan. 19, 2016 which claims priority to PCT Application No. PCT/US2014/047227 filed Jul. 18, 2014 and U.S. Patent Application No. 61/847,710 filed Jul. 18, 2013 from which PCT Application No. PCT/US2014/047227 claims priority.

FIELD OF THE INVENTION

The embodiments of the present invention relate to an automatic playing card shuffler and other card-handling devices incorporating means for detecting various types of marked cards to maintain the integrity of casino games.

BACKGROUND

Cheats have been around as long as gambling. With the advancement of technology, come new methods for cheats to take advantage. One such method involves marking playing cards such that cheats are able to discern a card's identity (i.e., rank and suit) from the card back. Knowing the rank and suit provides the cheat with a tremendous advantage over the casino (e.g., blackjack) or competing players (e.g., poker). Marking playing cards can take many forms including the use of invisible chemicals viewable through special lenses, the use of chemicals only viewable via electronic means, physical demarcations and anomalies, smudges, etc.

It would be useful and advantageous to develop an automatic playing card shuffler and other card-handling devices incorporating means for detecting marked cards of various types to prevent cheats from taking advantage of casinos and competing players.

SUMMARY

Accordingly, one embodiment of the present invention comprises: an automatic playing card shuffler incorporating means for detecting marked cards. Automatic playing card shufflers have been around for approximately 25 years and are now ubiquitous in the casino industry. Automatic playing card shufflers speed up games, generate reliable, random card shuffles and combat card counters. Automatic playing card shufflers transport cards using various technologies which ultimately randomize the order of the cards.

In one embodiment of the present invention, one or more light spectrum emitters or variable light spectrum illuminators transmit light at frequencies/wavelengths which is reflected off card backs through one or more spectrum filters causing invisible markings to become visible. A camera (or other image capturing device) captures images of the now visible markings.

In one embodiment, a camera and software collaborate to capture images and analyze the same for markings on the card backs such as smudges, nicks, scuffs and edge demarcations. Software may also be configured to analyze cards through and cause an image to be captured responsive to the detection of a marked card.

In one embodiment, the automatic playing card shufflers are configured to not only detect marked cards but to detect patterns relative to the card markings. For example, the automatic playing card shufflers may recognize that markings on multiple Aces in the deck of cards are indicative of an intentional act rather than an inadvertent act.

In one embodiment, the automatic card shufflers are communicatively linked with a casino management system and/or security system such that casino personnel may be alerted in real time to the discovery of marked cards.

The discovery of one or marked cards may prompt one or more responses including: (i) recordation of an image of the marked card(s); (ii) transmission of an alert to casino personnel; (iii) trigger of software configured to determine card marking patterns; and/or (iv) continued analysis to seek the identity of the person or persons responsible for the card markings.

In another embodiment, a card sorting, verification and/or cancellation device incorporates means for detecting marked cards. Card cancellation devices are used to verify the ranks, suits and numbers of playing cards from retired decks of cards. The devices may also permanently deface the playing cards to allow the playing cards to be sold to patrons. For example, the card cancellation device may punch a hole in the playing cards. A card sorting and verification device ensures full decks and sorts the cards by suits and ranks.

Other variations, embodiments and features of the present invention will become evident from the following detailed description, drawings and claims.

BRIEF DESCRIPTION OF THE DRAWINGS

FIGS. 1A and 1B illustrate in-table and on-table automatic playing card shufflers, respectively, according to the prior art;

DETAILED DESCRIPTION

Figure 2:
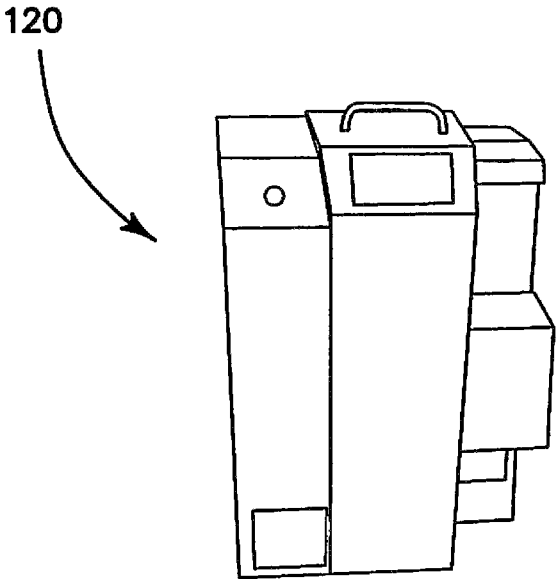
FIG. 2 illustrates a conventional deck verification device according to the prior art.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to those skilled in the relevant art and having possession of this disclosure, are to be considered within the scope of the invention claimed.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagram block or blocks. As used herein, a "terminal" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

FIGS. 1A and 1B show conventional automatic playing card shufflers 100 (in-table), 110 (on-table) and FIG. 2 shows a conventional deck verification device 120. These are the types of automatic card playing shufflers and devices with which the embodiments of the present invention may be used but those skilled in the art will recognize that any automatic playing card shufflers (e.g., single deck, multi-deck, batch, random-position, random-selection, etc.), card verification devices and card cancellation devices are suitable for the embodiments of the present invention. Card shuffling devices may use rollers, elevators, bins, ejectors, carousels, etc., to move and randomly organize the unshuffled group of cards into a random shuffled group of cards.

Figure 3:
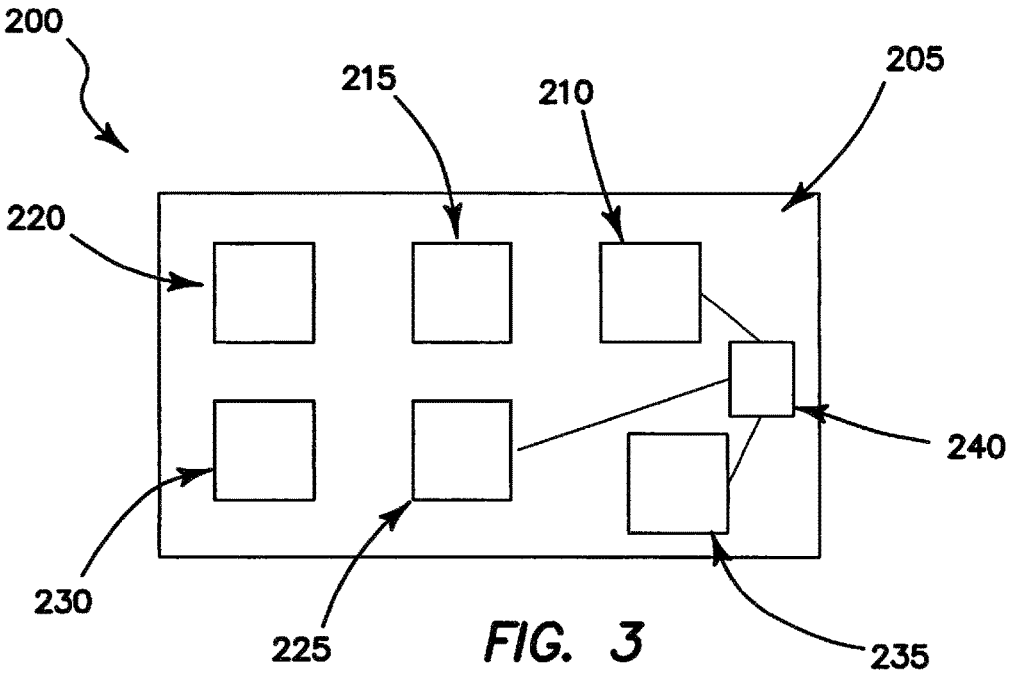
FIG. 3 illustrates a block diagram of an automatic playing card shuffler incorporating means for detecting marked cards according to the embodiments of the present invention.

FIG. 3 shows a block diagram 200 of an automatic playing card shuffler 205 incorporating means for detecting marked cards. In this instance, the means for detecting marked cards comprises one or more cameras 210 (or other image capturing devices), one or more light spectrum emitters or variable light spectrum illuminators/emitter 215, one or more spectral filters 220, one or more edge sensors 225, one or more receivers 230 and/or one or more data transmitters 235. There can also be temporary memory 240 for storing certain data including identification of marked cards. In one embodiment, the automatic playing card shuffler 205 includes a display device for alerting the dealer or other casino personnel that one or more marked cards have been detected. Ideally, the display device is not visible to the players so as not to alert any players that may be responsible for the card markings. As set forth below, a wireless system may also alert a casino management system and/or security system to the discovery of marked playing cards. The position of the various components described herein is dependent upon the type of automatic playing card shuffler, deck verification device and/or card cancellation device.

The one or more cameras 210 are positioned to capture the front and back of the playing cards as the playing cards are moved individually within the automatic playing card shuffler 205. In one embodiment, one camera 210 is positioned proximate to a spectral filter 220 and is configured to capture an image of the card backs as the one or more light spectrum emitters 215 is in operation. In this manner, the camera 210 captures any invisible markings made visible by the spectral filter 220 and light spectrum emitter 215. In one embodiment, the one or more spectrum emitters/variable light spectrum illuminators 215 may comprise an infrared emitter, UV emitter and/or incandescent emitter. Other emitters/variable light spectrum illuminators or devices capable of transmitting desirable light wavelengths may be utilized as well. To enhance the capability to detect invisible (to the naked eye) marks, the spectral filter 220 is configured to prevent the passage of certain light wavelengths while allowing others to pass through to the camera 210. The spectral filter 220 may take many forms and are selected to cooperate with the various spectrum emitters/variable light spectrum emitter/illuminator 215. The spectral filter 220 enhances the ability to detect polarized and subtle reflectivity facilitated by the spectrum emitters/variable light spectrum illuminator 220.

Figure 7:
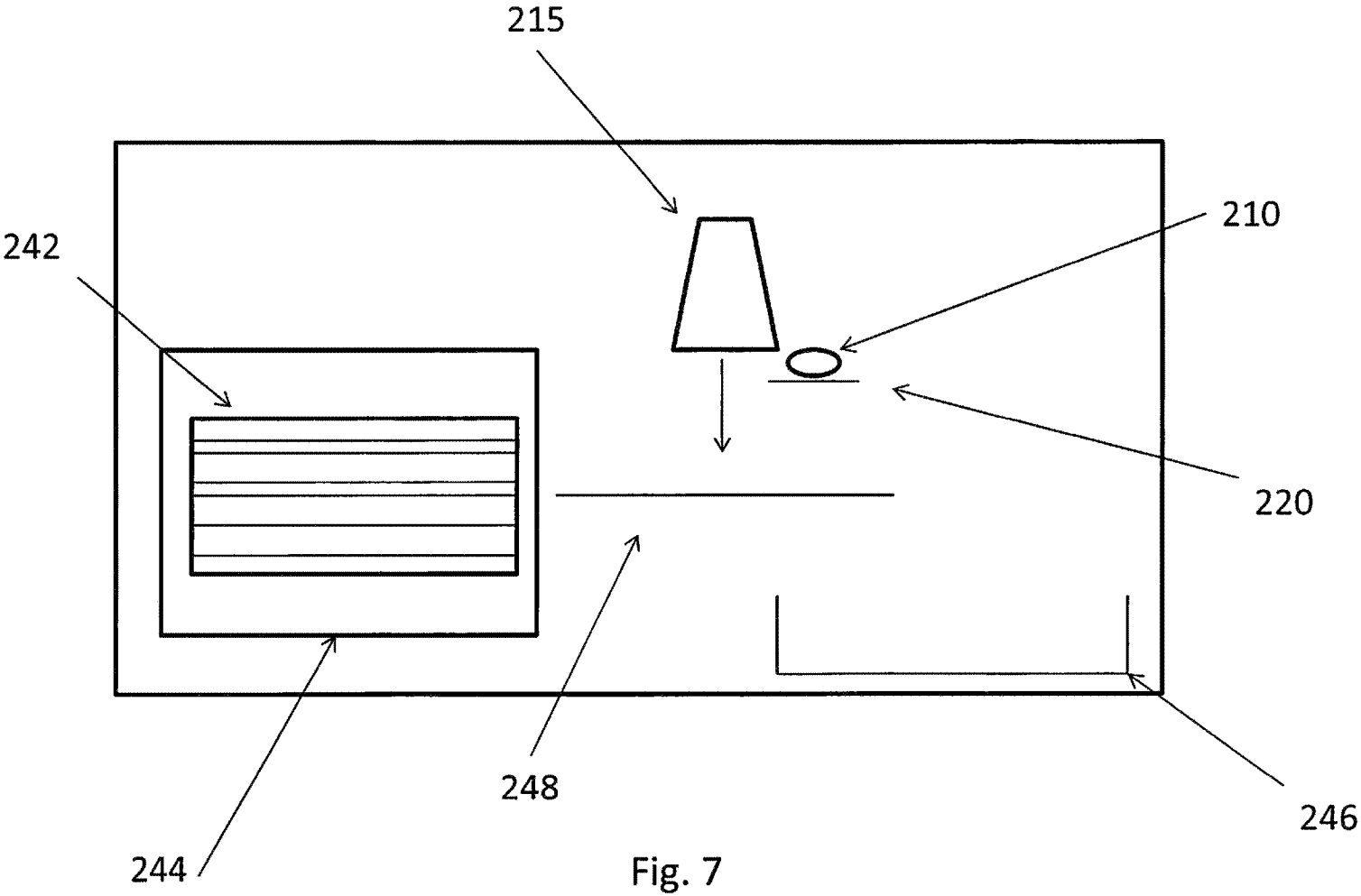
FIG. 7 illustrates a block diagram of an exemplary automatic shuffler incorporating a card mark detection system according to the embodiments of the present invention.

FIG. 7 shows an exemplary arrangement of an image capturing device 210, illuminator 215 and spectral filter 220 relative to a group of cards 242, mechanism to move and randomly organize said cards 244 and shuffled card bin 246. Moving card 248 is shown being acted on by the image capturing device 210, illuminator 215 and spectral filter 220.

Figure 4:
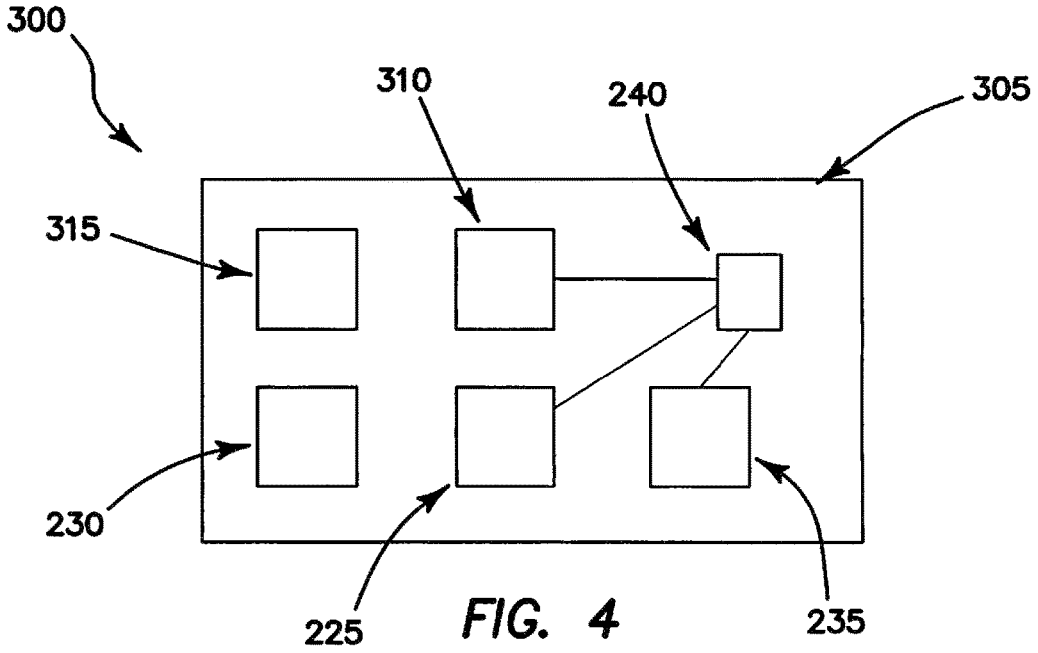
FIG. 4 illustrates another block diagram of an automatic playing card shuffler incorporating means for detecting marked cards according to the embodiments of the present invention.

In another embodiment (shown in FIG. 4) suitable for automatic playing card shufflers or other card-handling devices with limited internal space, a different imaging method may be used. FIG. 4 shows block diagram 300 of automatic playing card shuffler 305. In this embodiment, a contact image sensor 310 and a light emitter 315 capable of emitting near infrared (IR) to ultraviolet (UV) wavelengths (i.e., 350 nanometer wavelengths to 1100 nanometer wavelengths) in 75 nanometer steps such that markings are evident based on their absorption and/or excess reflectivity at given wavelengths. In one embodiment, the playing card is passed beneath or above the contact image sensors 310 which consists of a series of silicon or germanium detectors which respond to the wavelengths of light described above. In one embodiment, the detectors used in the contact image sensors 310 are set for 200 pixels per inch although the detectors can be more or less focused depending on the application needs. In practice, the cards are transported very close to the contact image sensors 310 such that the detectors are nearly in contact with the playing cards. The playing cards are then illuminated by high speed pulses via the light emitter 315, in sequence, with the wavelengths from 350 nanometers to 1100 nanometers in 10 separate illuminations. This process takes approximately 1/1000 of a second. The playing card then advances to a next scan position where the process is repeated.

In one embodiment, playing cards are transported at a rate providing a resolution of 200 by 200 pixels per square inch giving 350,000 scan points for every playing card which occurs at each of 10 scan locations resulting in a total of 3.5 million points of analysis. Those skilled in the art will recognize that the rate, resolution and number of scanning locations can be altered as desired.

In addition to the efforts to detect invisible markings, the one or more cameras 210 cooperate with software to detect other card markings such as smudges, nicks and scuffs and edge demarcations (e.g., notches). The software is configured to analyze a card image (or live feed of the playing card) for unusual markings which are not normally present. In one embodiment, the software is able to evaluate captured playing card data by comparing stored card data against captured card data for differences. For example, an image of an ideal Hoyle® playing card is stored in memory and used to compare against captured playing card data from one or more Hoyle® decks of cards. In such an embodiment, the shuffler, or other randomization device may include input means for identifying the brand of playing being used or the device may automatically identify the brand of playing cards being used. Alternatively, the software is able to evaluate the captured card data by locating imperfections on one or more playing cards from amongst the aggregate group of playing cards. In this embodiment, images of the cards being used may be compared to one another rather than a stored playing card image. Alternatively, the software is able to evaluate captured playing card data by identifying any non-symmetric or non-pattern marking which is captured. Regardless of the embodiment, the software is evaluating the playing card data captured by the arrangement of illuminators/emitters and sensors/readers to detect anomalies. With a camera positioned to capture a card front (i.e., rank and suit), the software is able to maintain a record of the marking and playing card suit and rank. For example, the software may generate a record of "Ace of Hearts—Notch Along Edge" or "Ace of Hearts—Smudge."

Figure 8:
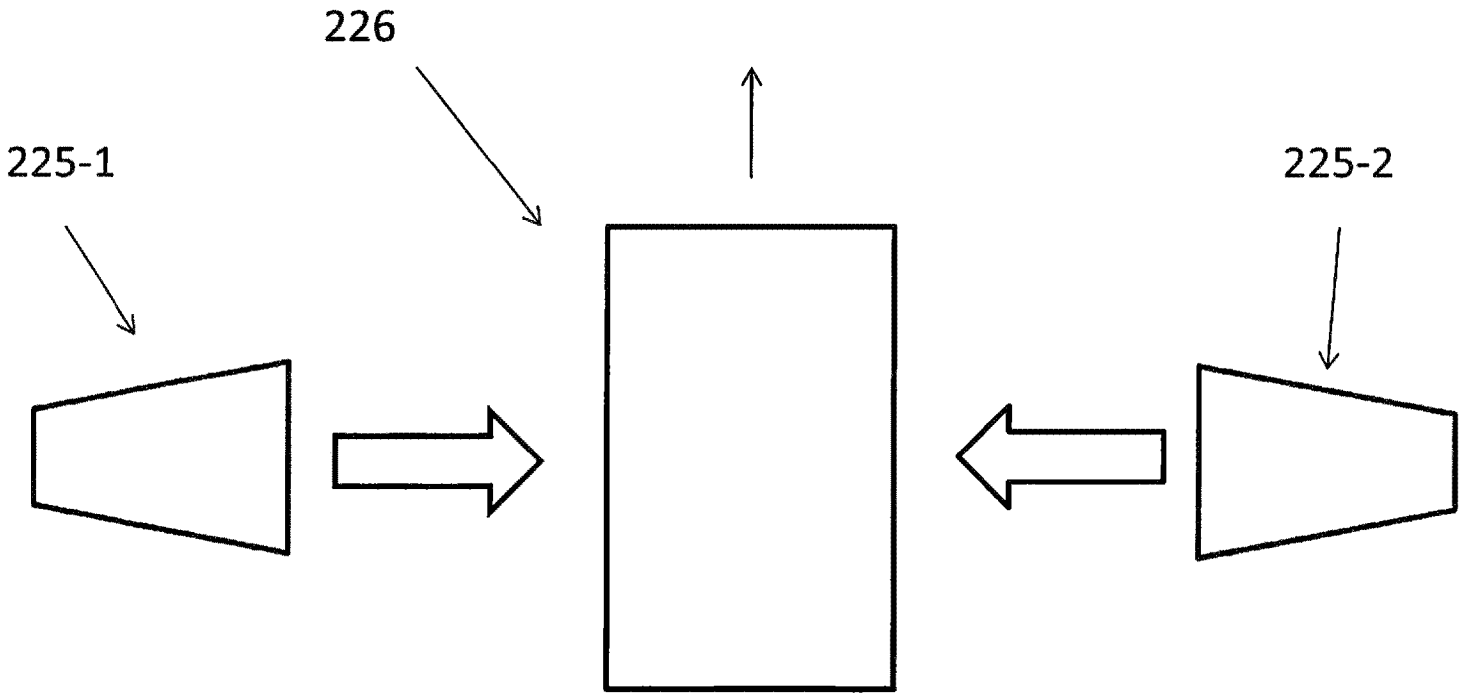
FIG. 8 illustrates an overhead view of a playing card passing between a pair of edge sensors/detectors according to the embodiments of the present invention.

In one embodiment, a pair of edge sensors/detectors 225-1, 225-2 are positioned along opposite long edges of the playing cards as they pass by the pair of edge sensors/detectors 225-1, 225-2. The edge sensors/detectors 225-1, 225-2 are configured to detect bends, waves or snakes in the cards. A single edge sensor along one edge may suffice as well. FIG. 8 shows an overhead view of a playing card 226 passing between a pair of edge sensors/detectors 225-1, 225-2. That is, the edge sensors/detectors 225-1, 225-2 detect whether the playing cards are flat (like they should be) or have some unusual bends or waves. In this instance, the detectors are of a higher resolution but much shorter pulse while using the same illumination sequence as disclosed above. The playing cards trigger different pixels as they undulate up and down while passing by the edge sensors/detectors 225-1, 225-2. The information collected is translated into an amount of warp and/or kink and may be correlated with the rank and suit of the playing card to determine patterns indicating purposeful manipulation.

In one embodiment, the outputs of the camera 210, edge sensors 225-1, 225-2 and/or contact image sensors 310 (and any other card-handling devices configured to read the playing cards) are analyzed by proprietary software to determine if any unusual markings are present. If so, the outputs may be stored in memory 240 and as described below transmitted to casino personnel.

Figure 5:
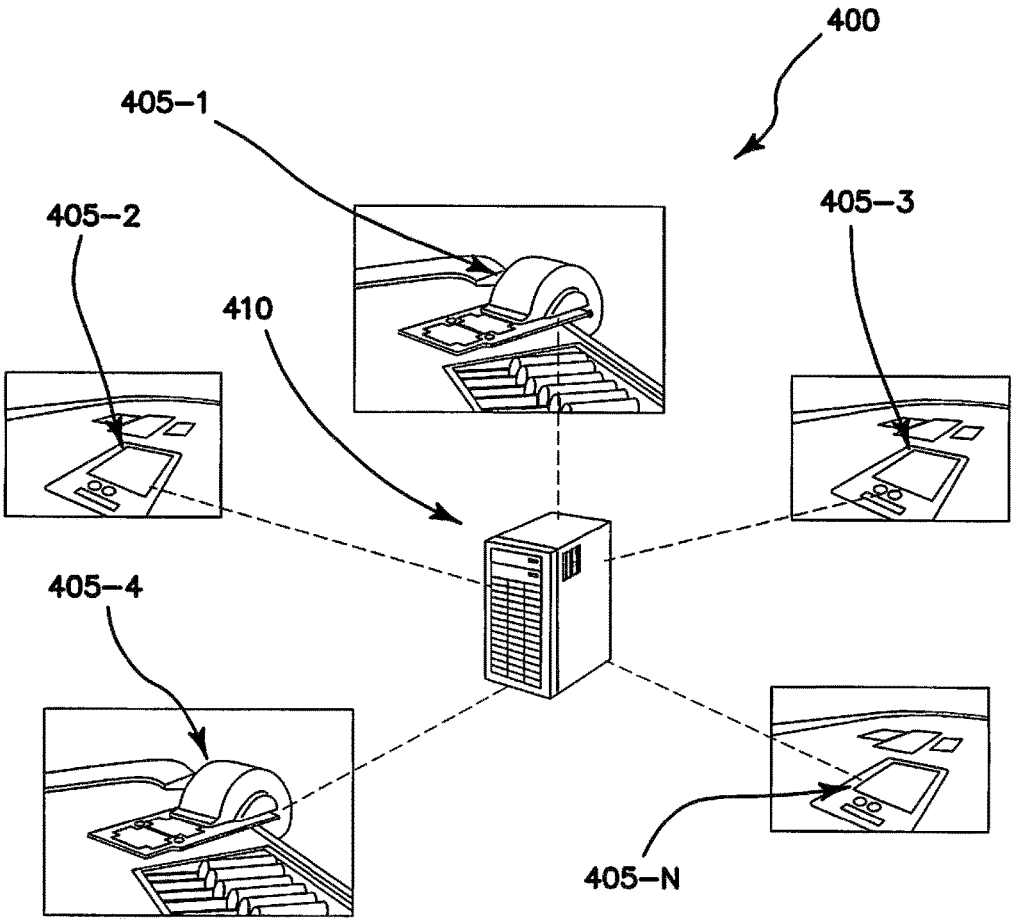
FIG. 5 illustrates a system comprising a series of automatic playing card shufflers and casino management system and/or security system according to the embodiments of the present invention.

FIG. 5 shows a system 400 comprising a series of shufflers 405-1 through 405-N in wireless communication with a casino management system and/or security system running on a remote server 410. Such a system 400 provides casinos with real-time data related to marked cards thereby maintaining the integrity of the casino game within the casino.

Figure 6:
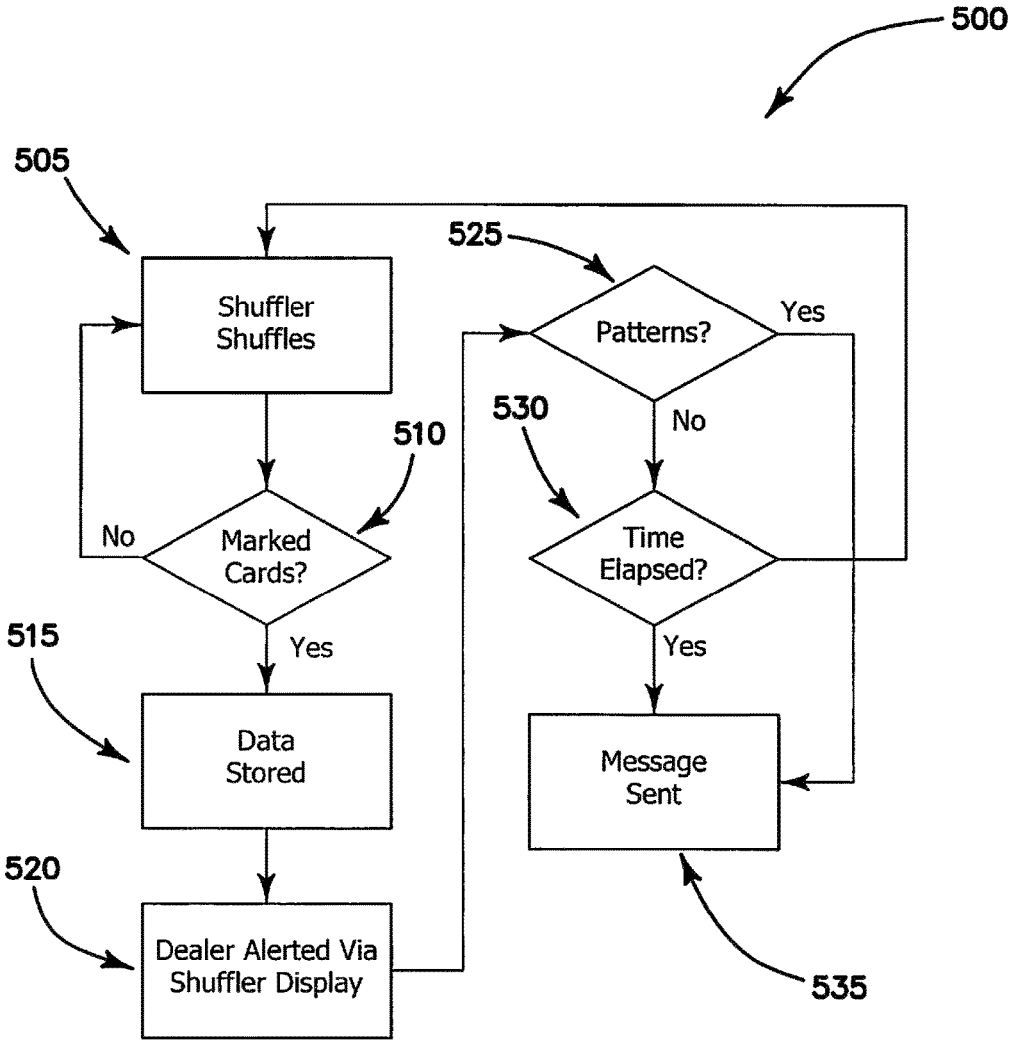
FIG. 6 illustrates a flow chart detailing one methodology for utilizing a system comprising a series of automatic playing card shufflers according to the embodiments of the present invention.

FIG. 6 shows a flow chart 500 detailing one methodology of using an automatic playing card shuffler within the system 400. At 505, the automatic playing card shuffler shuffles cards. At 510, it is determined if any unusual card marks are detected by any of the automatic playing card shuffler. If not, the flow chart 500 loops back to 505. At 515, responsive to detecting a marked card, the automatic playing card shuffler stores related data in memory associated with the automatic playing card shuffler. In one embodiment, the data include the type of mark, and rank and suit of the playing card. At 520, an automatic playing card shuffler display alerts the dealer to a marked card. Ideally, the display is not easily viewable by the players. The display may also be remote from the automatic playing card shuffler (e.g., beneath the table proximate the dealer) and controlled via a wired or wireless communication link. At 525, it is determined if any patterns have been detected by the proprietary software. For example, if the multiple cards with marks are face cards and/or Aces, it is more likely that the marks were placed intentionally. If so, at 535, a wireless message is sent to casino personnel via the casino management system and/or security system. The wireless message may include information such as the table location, marking types and time of the discovery. At 530, it is determined if a pre-established time has elapsed where the pre-established time is triggered by the first discovery of a marked card by the automatic playing card shuffler. If so, at 535, a wireless (or wired) message is transmitted to casino personnel via the casino management system and/or security system. In another embodiment, specific casino personnel may be alerted to the card markings directly by email, SMS and/or instant messages from the automatic playing card shuffler or by email, SMS and/or instant messages triggered by the casino management system and/or security system. In other embodiments, casino personnel are alerted to any and all detections of marked cards immediately upon the detection. An optional receiver 230 incorporated within the automatic playing card shufflers may allow for routine polling of the automatic playing card shufflers. Ultimately, the house or casino determines how to manage the system 400 and detections of marked cards.

In one embodiment, the automatic playing card shuffler is able to track the cards which are dispensed and the order of the same, which along with means for detecting the marked cards, allows a casino to secretly determine which player or players are responsible for marking the cards and discipline them accordingly.

Besides automatic playing card shufflers, deck verification devices and card sorting devices, applicant has conceived of incorporating certain components (e.g., emitters and spectral filters) into a pair of eyeglasses whereby a user is able to detect certain card markings when wearing the eyeglasses. Applicants incorporate herein by reference Application No. 61/830,565 filed Jun. 3, 2013 and entitled Mobile Device for Detecting Marked Cards and Method of Using the Same.

Although the invention has been described in detail with reference to several embodiments, additional variations and modifications exist within the scope and spirit of the invention as described and defined in the following claims.

We claim:

1. A card-shuffling device for shuffling playing cards comprising:

one or more mechanisms for automatically moving individual playing cards from one or more decks of playing cards in a card input position to a card output position in a manner to randomly shuffle the one or more decks of playing cards;

one or more illuminators configured to emit light off of playing card backs as said one or more mechanisms move said playing cards from said card input position to said card output position, said one or more illuminators further configured to emit light in incremental wavelengths between near IR to UV wavelengths;

one or more contact image sensors positioned between said card input position and said card output position and configured to capture images of said card backs based on intensity of light reflected off of said card backs; and a processor configured to cause a comparison of each captured card back image against all other card back images captured during a shuffle of said one or more decks of playing cards to identify undesirable markings associated with any of said playing cards within said one or more decks of playing cards.

2. The device of claim 1 wherein said one or more illuminators are further configured to emit light incrementally in wavelengths between 350 nanometers and 1100 nanometers.

3. The device of claim 1 wherein said one or more illuminators are further configured to emit light incrementally in wavelengths between 350 nanometers and 1100 nanometers in 75 nanometer increments.

4. The device of claim 1 wherein said mechanism is further configured to sort said one or more decks of playing cards.

5. The device of claim 1 wherein said mechanism is further configured to deface said one or more decks of playing cards.

6. A card shuffling device comprising:

one or more mechanisms for automatically moving individual playing cards from one or more decks of playing cards in a card input position to a card output position in a manner to randomly shuffle the one or more decks of playing cards;

one or more illuminators configured to emit light off of playing card backs as said one or more mechanisms move said playing cards from said card input position to said card output position, said one or more illuminators further configured to emit light in incremental wavelengths between near IR to UV wavelengths;

one or more contact image sensors configured to capture images of said card backs based on intensity of light reflected off of said card backs; and a processor configured to cause a comparison of each captured card back image against all other card back images captured during a shuffle of said one or more decks of playing cards to identify undesirable markings associated with any of said playing cards within said one or more decks of playing cards.

7. The card shuffling device of claim 6 wherein said one or more illuminators are further configured to emit light incrementally in wavelengths between 350 nanometers and 1100 nanometers.

8. The card shuffling device of claim 6 wherein said one or more illuminators are further configured to emit light incrementally in wavelengths between 350 nanometers and 1100 nanometers in 75 nanometer increments.

9. The card shuffling device of claim 6 wherein said mechanism is further configured to sort said one or more decks of playing cards.

10. The card shuffling device of claim 6 wherein said mechanism is further configured to deface said one or more decks of playing cards.

11. A method of shuffling playing cards and identifying marked playing cards comprising:

mechanically moving individual playing cards from one or more decks of playing cards in a card input position to a card output position in a manner to randomly shuffle the one or more decks of playing cards;

emitting light incrementally in wavelengths between IR and UV wavelengths off of playing card backs as said one or more decks of playing cards are moved mechanically from said card input position to said card output position; and utilizing one or more contact image sensors to capture images of said card backs based on intensity of light reflected off of said card backs; and configuring a processor to cause a comparison of each captured card back image against all other card back images captured during a shuffle of said one or more decks of playing cards to identify undesirable markings associated with any of said playing cards within said one or more decks of playing cards.

12. The method of identifying marked playing cards of claim 11 further comprising utilizing one or more illuminators configured to emit light incrementally in wavelengths between 350 nanometers and 1100 nanometers.

13. The method of identifying marked playing cards of claim 11 further comprising utilizing one or more illuminators configured to emit light incrementally in wavelengths between 350 nanometers and 1100 nanometers in 75 nanometer increments.

14. The method of identifying marked playing cards of claim 11 further comprising sorting said group of playing cards as said playing cards are moved from said one or more decks of playing cards.

15. The method of identifying marked playing cards of claim 11 further comprising defacing said playing cards as said playing cards are moved from said one or more decks of playing cards.

16. A card-shuffling device for shuffling playing cards comprising:

one or more mechanisms for automatically moving individual playing cards from one or more decks of playing cards in a card input position to a card output position in a manner a first group to randomly shuffle the one or more decks of playing cards;

one or more illuminators configured to transmit emit light off of playing card backs as said one or more mechanisms move said playing cards from said card input position to said card output position said first group of playing cards into a second shuffled group of playing cards, said one or more illuminators further configured to incrementally transmit emit light in incremental wavelengths between near IR to UV wavelengths;

one or more contact image sensors configured to capture images of said card backs based on intensity of light reflected off of said card backs; and a software application for creating a normal range, based on captured images of each of said playing cards in play at live games across one or more game tables, for purposes of comparing each captured card back image against all other card back images captured during a shuffle of said one or more decks of playing cards to identify undesirable markings outside of said normal range, including at least one or more of the following: smudges, nicks, scuffs, edge demarcations and/or asymmetric patterns.

* * * * *